United States Patent [19]

Solbakken

[11] 4,145,189

[45] Mar. 20, 1979

[54] PROCESS FOR PREPARING A CLEAN-BURNING, LOW SULPHUR LIQUID FUEL FROM COAL

[75] Inventor: Åge Solbakken, Montgomery, Tex.

[73] Assignee: Energy Conversion Systems Limited, London, United Kingdom

[21] Appl. No.: 806,135

[22] Filed: Jun. 13, 1977

[30] Foreign Application Priority Data

Sep. 8, 1976 [GB] United Kingdom ..... 37293/76

[51] Int. Cl.[2] ..... C10L 1/32

[52] U.S. Cl. ..... 44/51; 208/8

[58] Field of Search ..... 44/51; 208/8, 97, 211

[56] References Cited

U.S. PATENT DOCUMENTS

| | | | |
|---|---|---|---|
| 827,139 | 7/1906 | Brown et al. | 44/51 |
| 1,657,815 | 1/1928 | Bates | 44/51 |
| 3,197,305 | 7/1965 | Carlson | 44/51 |
| 3,902,991 | 9/1975 | Christensen et al. | 208/211 |

OTHER PUBLICATIONS

"Laboratory Carbonization of Coals", Synthetic Fuels Data Handbook, Hendrickson, Copyright 1975, pp. 154–1952.

"Utilization of Chars", Chemistry of Coal Utilization, Lowry, 1963, pp. 451–453.

*Primary Examiner*—Winston A. Douglas
*Assistant Examiner*—Y. Harris-Smith
*Attorney, Agent, or Firm*—Fulbright & Jaworski

[57] ABSTRACT

Coal is subjected to a pyrolysis process which produces an oil fraction, a char, a water fraction, and a gas by-product. The oil fraction may be desulphurized, and the ash and sulphur removed from the char by micronizing the char and using known methods to separate the carbon from the ash and sulphur. The liquid oil fraction, micronized char, and water fraction are combined and blended with or without a stabilizing agent to form a clean-burning, low sulphur liquid fuel suspension which can be transported in pipes or in bulk, and stored. A stabilizer can be applied to the blend in order to increase its stability. Common fuel oil may also be added to the resulting liquid fuel without danger of separation. When the char is micronized to less than 200 standard mesh, at least 50% by weight of the entire suspension can be the char.

10 Claims, No Drawings

PROCESS FOR PREPARING A CLEAN-BURNING, LOW SULPHUR LIQUID FUEL FROM COAL

BACKGROUND OF THE INVENTION

Coal as a heat source is in abundant supply. Most coal, however, contains certain amounts of sulphur which, when the coal is burned, are expelled into the air as sulphur oxides, i.e., pollutants. Because of definitive regulations by governmental agencies that limit the amount of sulphur oxides allowed to be exhausted into the air, it has become necessary and costly to process the coal for cleaner burning. An even greater inhibitor to the use of coal as a fuel source is the mode of its burning. While coal has been historically burned in beds and in more recent years by the spraying of atomized coal particles into a burning chamber, coal is not readily usable in standard industrial oil burners. A conventional approach to the foregoing problems has been to augment regular fuel oils with micronized coal, but the stability thereof is low and the oil-coal mixture separates easily.

PRIOR ART STATEMENT

Pertinent prior art is that found in U.S. Pat. No. 3,941,532 issued to Cottell which employs a process for making and burning a water-in-oil mixture containing pulverized coal, using sonic energy to stabilize the suspension, and adding limestone to minimize the emission at burning of sulphur oxides present in the slurry. The literature describes methods for using special stabilizers for the slurry. However, the cost of stabilizers is often excessive, and the cost per BTU of the final product is often equal to or above the cost of regular liquid fuel oils.

Advantageously, the present invention relates to a process for preparing a clean-burning, low sulphur liquid fuel from coal which is compatible with most regular burners, which minimizes the emission of sulphur oxides, and is stable.

SUMMARY OF THE INVENTION

Thus, a principal object of the present invention is to provide a process for preparing a clean-burning, low sulphur liquid-like fuel from coal, by subjecting the coal to an economic, low or medium temperature pyrolysis process (in which pyrolysis temperatures range from about 700° F. to about 1500° F.) resulting in an oil fraction, a char, a water fraction, and a gas by-product.

Another object of the present invention is to provide a process for producing a clean-burning, low sulphur liquid fuel from coal which can easily be pumped and transported in bulk, and is adaptable to conventional oil burners.

A further object of the present invention is to provide a process for preparing a clean-burning, low sulphur liquid fuel from coal which has an ash level in the resulting fuel of less than about 0.5% by weight, and a sulphur level in the fuel of less than about 0.5% of the carbon and hydrocarbons present.

A still further object is to provide a clean-burning, low sulphur liquid fuel from coal in suspension form which is sufficiently stable without the addition of a stabilizer.

A yet further object of the present invention is to aid the stability of the suspension while reducing the expense of preparing the fuel by utilizing in the fuel the water fraction resulting from the pyrolysis of the coal.

An even further object of the present invention is to provide a process for preparing a clean-burning, low sulphur liquid fuel from coal in which regular grades of common fuel oils can be mixed into the fuel of the present invention without danger of separation.

Still further objects, features and advantages of the present invention will be apparent from the description of the preferred embodiment.

The present invention relates to a process for preparing a clean-burning, low sulphur liquid fuel from coal. Coal is subjected to a process of low or medium temperature pyrolysis, which process is well known in industrial circles, such that four components are produced: (1) a liquid oil fraction; (2) a char; (3) a water fraction; and (4) a gas by-product.

The liquid oil fraction contains normal paraffinic hydrocarbons, aromatics, polyaromatics and oxycompounds such as phenols, cresols, organic acids and the like. The composition varies with the process as high temperature tends to crack the high boiling components. The liquid oil is excellent for fuel if certain measures such as denitrification and desulphurization by known methods are taken. The oxygenated compounds of the oil fraction greatly enhance the stability of the suspension of the resulting fuel of the present invention and thus are highly desirable components.

The char from the pyrolysis process normally contains most of the inorganic sulphur of the coal, namely in the ash. In the present invention, the ash is removed by conventional char micronizing methods followed by separation of the ash and sulphur from the char by known methods such as flotation, gravity separation or chemical conversion. The remaining char is composed mainly of carbon, with only very small amounts of sulphur left. By these techniques, the ash content can be kept at levels comparable with fuel oils, and the sulphur content within the limits set by environmental regulations. The resulting char is thus useful in the composition of the present invention.

A by-product of the pyrolysis process is the liquid water fraction, the amount of the liquid water fraction being dependent largely upon the water content of the coal. This liquid water fraction is usually contaminated with volatile components which to a certain degree dissolve in the water phase. Disposal of this water, therefore, normally requires cleaning measures which add to the cost of the conventional operations. It has been determined, however, that this liquid water fraction is useful in the present invention.

The process of pyrolysis also results in a gas by-product which usually has a high content of higher molecular weight hydrocarbons, thus giving a high BTU gas that serves as an excellent fuel. Some of the organic sulphur in the coal usually accompanies the gas in the form of hydrogen sulfide, sulphur dioxide, carbonylsulfide, mercaptans, and other similar compounds which can be extracted by known methods.

The present invention is directed to the mixing of the products formed by a coal pyrolysis process, namely, a mixing of the desulphurized liquid oil fraction, the micronized char from which the ash and sulphur largely have been removed, and water which can be the water fraction produced in such a coal pyrolysis. The resulting mixture is thoroughly blended either with or without a stabilizing agent, and forms a stable suspension which can be transported in pipes or in bulk and stored, and gives a clean-burning fuel with a BTU value in the range of 11,000 to 14,000 BTU's per pound, dependent upon the composition.

When the char produced from the pyrolysis process is micronized and the ash is removed by a commonly known method such as but not limited to gravitation, flotation or chemical methods, the resulting char is composed mainly of carbon. Furthermore, when the char is micronized to less than about a 200 standard mesh, the weight of the micronized and suspended char when compared to the total weight of the liquid fuel suspension of the present invention can be varied from 0 to at least 50%. Advantageously, the high carbon content increases the BTU per pound output while minimizing the effluence of sulphur oxides, and the presence of water in the resulting fuel lowers the viscosity of the latter to make it more suitable for pumping, for example, through pipelines. Furthermore, the addition of water to the char-oil mixture dramatically reduces the soot formation in boiler furnaces and also permits leaner air/fuel mixtures. The water and emulsion promotes the exploding of the fuel droplets, thus giving a more intimate mixture of fuel and air during combustion. Water also reacts with carbon and hydrocarbons to form easily combustible carbon monoxide and hydrogen.

New low and medium temperature pyrolysis processes are industrially economic, and have characteristics which maximize either gas or liquids from the coal, giving a high-surface area char with small amounts of volatile matter. The relative proportions of the components in the composite fuel can readily be changed within wide limits. For example, the water content can easily be lowered to about 1% to 2% by weight of the total composite fuel without sacrificing suspension quality, and can be as high as about 25% by weight without influencing the flame characteristics so long as proper burner adjustments are made. Moreover, the char content can be any amount, even more than 50% by weight, of the fuel, recognizing that both stability and viscosity are influenced at a higher char content.

The char from the pyrolysis process forms a stable suspension much more easily than does coal, in that the pyrolytic char has a high surface area due to the micropores formed during the pyrolytic process. Consequently, the addition of stabilizers to the fuel normally is not necessary. If even greater stability of the fuel is desired, however, such increased stability can be attained by the addition of organic or inorganic suspension stabilizers as will be appreciated by those skilled in the art.

Description of the Preferred Embodiment

As a preferred embodiment of the present invention, coal is subjected to any suitable conventional low or medium temperature pyrolysis process, which results in a liquid oil fraction, a char, a water fraction, and a gas by-product.

The resulting char, the liquid oil fraction and the water fraction are thus the components of the final fuel product. The components may be mixed in any order and in any proportion so long as combustion of the fuel can occur, but a preferred embodiment is to use (A) 5 parts by weight of the micronized, relatively ash-free char and mix it with 1.5 parts by weight of the water fraction and (B) 3 parts by weight of the oil fraction oil intimately mixed with 0.5 parts by weight of the water and then mix A into B by pouring mixture A into a stirred tank containing mixture B, or using a continuous mixer for the process. Depending on the oil fraction and the preferred viscosity of the mix, the relation between A and B can be changed to comply with the requirements for ultimate use. For example, if viscosity is to be altered, regular fuel oil can be added in which case it is preferred to divide mixture A, blending part of it with mixture B and the other part with what would otherwise be mixture B but wherein fuel oil is substituted for the pyrolytic oil fraction. Then the respective parts are combined. However, it is also possible to mix the fuel oil into the pyrolytic oil fraction and make the composite fuel as described above.

If the oil fraction from the pyrolysis process is heavy and contains sizeable amounts of tar, a preferred embodiment is to separate out the heavy tar by distillation. By using for instance about 700° F. as the cut point, the heavy tar fractioned out is usually solid at room temperature but liquid at boiling water temperature. This tar is intimately mixed into hot water (boiling or nearly boiling) to make a stable oil in water suspension at room temperature. The cold (room temperature) suspension is used in formulating the mixtures A and B above, except that the percentage of the components are adjusted for the content of tar in the water to end up with the required composition, i.e., the A and B mixture ratio.

The resulting fuel can be preheated and burned as No. 5 or 6 fuel oil. Properly adjusted, as is readily within the skill of the art, the combustion will be smoke free at low excess of air, which will minimize the formation of nitrogen oxides in the flue gas.

The liquid oil fraction is, if necessary, desulphurized by known methods, such as treating it with hydrogen at elevated temperatures. The char from the pyrolysis process is micronized preferably to less than about 200 standard mesh, and the ash and accompanying sulphur are removed by known methods such as, but not limited to gravitation, flotation or chemical methods. When using flotation, the size of the char particles has to be equal to or less than the size of the ash inclusions in the coal. A method for flotation as described in U.S. Pat. No. 3,794,250 where particle size is less than 1/16 of an inch is entirely unsatisfactory for most coals, as it has been found that it is necessary to be below 200 mesh with large amounts of the material going through a 325 mesh screen to be able to separate out the ash without too much loss in carbon. For most qualities of coal it is possible to decrease the ash content of the char to about 0.5% by weight or lower.

The water fraction, which is most likely contaminated with several volatile compounds, is not subjected to any cleaning measure. It may be used as a component of the final fuel product without further treatment.

What is claimed is:

1. A process for preparing a liquid-like fuel from coal, comprising the steps of:
   a. subjecting the coal to low or medium temperature pyrolysis, so as to form an oil fraction, a char, and a water fraction,
   b. micronizing the char to less than about 200 standard mesh, and
   c. forming a stable suspension comprising the liquid-like fuel by blending the oil fraction and the char from step (a) with water wherein (i) the oil fraction is mixed with the water in a ratio of about 3 to about 0.5 parts by weight, respectively, (ii) the micronized char is blended with the water in a ratio of about 5 to about 1.5 parts by weight, respectively, and (iii) the mixtures of steps (i) and (ii) are combined.

2. The process of claim 1 wherein fuel oil is mixed with the liquid-like fuel.

3. A process for preparing a liquid-like fuel from coal, comprising the steps of:

a. subjecting the coal to low or medium temperature pyrolysis so as to form an oil fraction, a char, and a water fraction, b. micronizing the char and removing substantial portions of ash and sulphur therefrom, c. desulphurizing the oil fraction, and d. forming a stable suspension comprising the liquid-like fuel by blending the oil fraction of step (c) and the char from step (b) with water.

4. The process of claim 3 wherein in step (b) the char is micronized to less than 200 standard mesh and the ash content thereof after removal is about 0.5% or less ash by weight.

5. The process of claim 4 wherein in step (d), (i) the oil fraction is mixed with the water in a ratio of about 3 to about 0.5 parts by weight, respectively, (ii) the micronized char is blended with the water in a ratio of about 5 to about 1.5 parts by weight, respectively, and (iii) the mixtures of steps (i) and (ii) are combined.

6. The process of claim 3 wherein common fuel oil is mixed into the liquid-like fuel.

7. A process for preparing a liquid-like fuel from coal, comprising the steps of:

a. subjecting the coal to a low or medium temperature pyrolysis so as to form an oil fraction, a char, and a water fraction, b. micronizing the char to less than 200 standard mesh and removing ash therefrom, the ash content after removal being about 0.5% or less by weight, c. desulphurizing the oil fraction, and d. forming a stable suspension comprising the liquid-like fuel by blending the oil fraction of step (c) and the char from step (b) with the water fraction from step (a).

8. The process of claim 7 wherein in step (d), (i) the oil fraction is mixed with the water in a ratio of about 3 to about 0.5 parts by weight, respectively, (ii) the micronized char is blended with the water in a ratio of about 5 to about 1.5 parts by weight, respectively, and (iii) the mixtures of steps (i) and (ii) are combined.

9. The process of claim 8 wherein at least common fuel oil is mixed into the liquid-like fuel.

10. A product produced by the process of claim 8.

* * * * *